US006405834B1

(12) United States Patent
Chida et al.

(10) Patent No.: US 6,405,834 B1
(45) Date of Patent: Jun. 18, 2002

(54) ELEVATOR MAINTENANCE/OPERATION APPARATUS

(75) Inventors: Akihiro Chida; Junichiro Ishikawa; Shigeki Yamakawa; Hiroshi Ando; Kunio Katou, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/856,249

(22) PCT Filed: Oct. 7, 1999

(86) PCT No.: PCT/JP99/05517

§ 371 (c)(1),
(2), (4) Date: May 18, 2001

(87) PCT Pub. No.: WO01/27013

PCT Pub. Date: Apr. 19, 2001

(51) Int. Cl.[7] ..... B66B 11/08; B66B 1/50

(52) U.S. Cl. ..... 187/391; 187/263

(58) Field of Search ..... 187/391, 298, 187/250, 254, 263, 313, 314, 316, 325, 414, 288

(56) References Cited

U.S. PATENT DOCUMENTS

| | | | | | |
|---|---|---|---|---|---|
| 5,740,888 | A | * | 4/1998 | Aulanko et al. | 187/336 |
| 5,971,109 | A | * | 10/1999 | Aulanko et al. | 187/263 |
| 6,029,778 | A | * | 2/2000 | Estallo et al. | 187/395 |
| 6,148,962 | A | * | 11/2000 | Hakala et al. | 187/254 |
| 6,227,335 | B1 | * | 5/2001 | Koeppe et al. | 187/395 |
| 6,230,845 | B1 | | 5/2001 | Yamakawa et al. | |
| 6,273,216 | B1 | * | 8/2001 | Kocher et al. | 187/254 |
| 6,302,240 | B1 | * | 10/2001 | Shih | 187/397 |

FOREIGN PATENT DOCUMENTS

| | | | | |
|---|---|---|---|---|
| DE | 296 15 921 | | 9/1996 | |
| JP | 2-33080 | Y | 2/1990 | |
| JP | 2-95692 | | 4/1990 | |
| JP | 5-97338 | A | 4/1993 | |
| JP | 05319710 | A * | 12/1993 | B66B/1/46 |
| JP | 06100264 | A * | 4/1994 | B66B/5/02 |
| JP | 8-290874 | X | 11/1996 | |
| JP | 10-36022 | | 2/1998 | |
| JP | 10-59635 | | 3/1998 | |
| JP | 10-87206 | | 4/1998 | |
| JP | 11-263557 | | 9/1999 | |
| JP | 11322210 | A * | 11/1999 | B66B/1/34 |

* cited by examiner

*Primary Examiner*—Jonathan Salata
(74) *Attorney, Agent, or Firm*—Leydig, Voit & Mayer, Ltd.

(57) ABSTRACT

In a maintenance driving control apparatus of an elevator, switches and other components operated at the time of maintenance are separated from a control panel and combined in a driving operation panel. A maintenance operation panel having this driving operation panel and at least one of a brake release device for remote operation, a meter for indicating a voltage of a speed generator, and car position confirmation unit utilizing movement of a rope or some other member is provided in the vicinity of an elevator hall. The maintenance driving control apparatus enables maintenance operations without directly operating the control panel or a hoisting machine.

13 Claims, 7 Drawing Sheets

ELEVATOR MAINTENANCE/OPERATION APPARATUS

TECHNICAL FIELD

The present invention relates to an elevator maintenance driving apparatus located separately from a control panel or a hoisting machine of an elevator for maintenance driving of the elevator.

BACKGROUND ART

Conventionally, elevator maintenance driving operations can easily be carried out because a machine room is provided separately from a hoistway in which a car that passengers get on is provided, and because a hoisting machine, a control panel and other main operating components to be operated during maintenance operations are installed in the machine room, as described in Japanese Patent Application Laid-open No. Hei 10-59635, which is a publication of a Japanese Patent Application. Also, it is described that when maintenance driving operations are required for maintenance operations in the hoistway, maintenance operations can easily be carried out by only one operator in the hoistway without any operator in the machine room by providing a driving control panel on the car.

In recent elevators, the number of devices conventionally disposed in the machine room, that are disposed in the hoistway and not in the machine room, has increased, because of need for efficient and economical utilization of building spaces. It is disclosed in Japanese Patent Application Laid-open No. Hei 8-40665, which is a publication of a Japanese Patent Application, that a hoisting machine is placed in a hoistway, and a control panel is integrally mounted in a landing door unit installed at an opening of the hoistway. When maintenance of this elevator is performed, a portion of a landing door is opened, the control panel therein is operated, and an operating component, e.g., the hoisting machine provided close to a window provided in the vicinity of the control panel to enable access to the inside of the hoistway is directly operated through the window.

Japanese Patent Application Laid-open No. Hei 2-95692, which is a publication of a Japanese Patent Application, discloses, with respect to an elevator having a control panel also placed in a hoistway, an arrangement in which an inspection driving switch is provided in an elevator hall separately from the control panel to perform maintenance driving operations in the hall. Also, Japanese Patent Application Laid-open No. Hei 10-87206, which is a publication of a Japanese Patent Application, discloses an example of an elevator in which a maintenance operations changing switch is provided in an inner portion of a hall button accommodation unit mounted in a hall jamb.

Accordingly, in maintenance operations for recent elevators without the machine room, since main operating components are installed in the hoistway, an operator enters the hoistway and performs operations for maintenance of the main operating components while the car moves in the same hoistway. In such a situation, it is necessary for the operator to be specially careful about safety. In particular, in the case of inspection or repair when the car is disabled from moving, it is difficult even to access operating components to be checked. In some cases, main operating components are placed in the vicinity of the landing door as described in the above-mentioned publication. In such a case, however, it is necessary that the operating components are concentratedly disposed in such a place as to be accessible from the landing door, thereby reducing the variance of placement of the components. Although, it is also disclosed that some of maintenance switches are provided in the hall by being separated from the corresponding main operating components to be operated for maintenance driving, it is necessary for an operator to operate the car under the eyes of the movement of the car. Therefore, a restriction is imposed on the selection of the place in which the operating switches are mounted.

DISCLOSURE OF THE INVENTION

The present invention has been made to solve the above-described problems. The present invention enables maintenance driving operations without entering a hoistway such that a maintenance operation panel for operating main operating components is provided in the vicinity of an elevator hall without specially limiting the location to a jamb at the hall, the maintenance operation panel including a device capable of ascertaining the movement of an elevator car, and a device for releasing a brake, the maintenance operation panel being operated in maintenance operations. A face plate of the maintenance operation panel is also used as a face plate attached with hall call buttons. That is, the maintenance operation panel is covered with devices ordinarily required at the hall to be prevented from impairing the hall design.

BEST MODE FOR CARRYING OUT THE INVENTION

Preferred embodiments of the present invention will be described with reference to the accompanying drawings.

Figure 1:
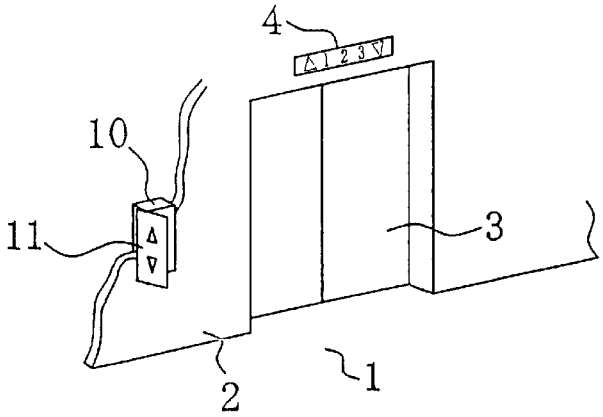
FIG. 1 is a perspective view showing a state where a maintenance operation panel of a maintenance driving apparatus in accordance with the present invention is attached to a hall.

FIG. 1 is a perspective view showing a state where a maintenance operation panel of a maintenance driving apparatus in accordance with the present invention is installed in a hall. In the figure, a maintenance operation panel is installed in an elevator hall 1. Reference numeral 2 denotes a wall in which an opening for an elevator is formed. The wall 2 is illustrated in a partially cutaway state. Reference numeral 3 denotes doors of the elevator hall 1. Reference numeral 4 denotes an elevator indicator provided in the hall 1. Reference numeral 10 denotes the maintenance operation panel of the elevator maintenance driving apparatus of the present invention, which is embedded in and attached to the wall 2. Reference numeral 11 denotes a face plate of the maintenance operation panel 10, which is shown in an opened state in FIG. 1. Hall buttons are provided in the face plate.

Embodiment 1

Figure 2:
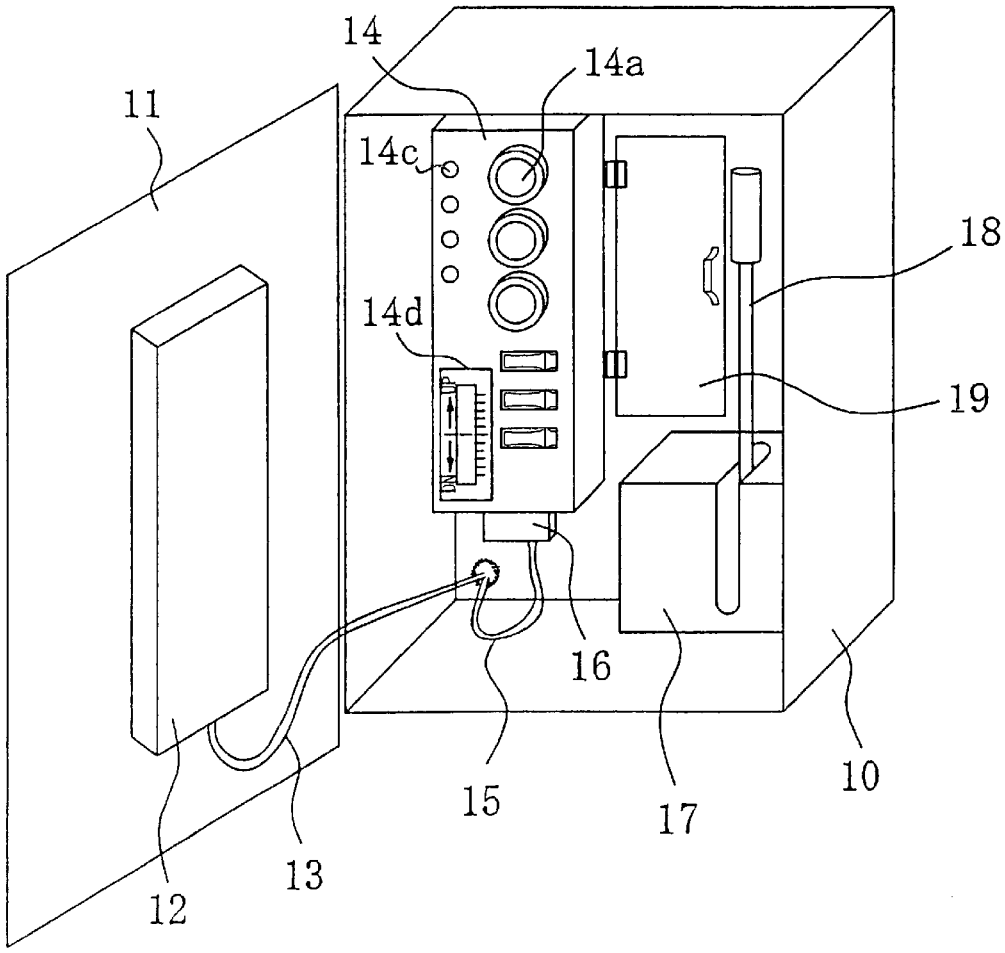
FIG. 2 is a perspective view of the maintenance operation panel of the maintenance driving apparatus, showing a state where a face plate is opened.
Figure 3:
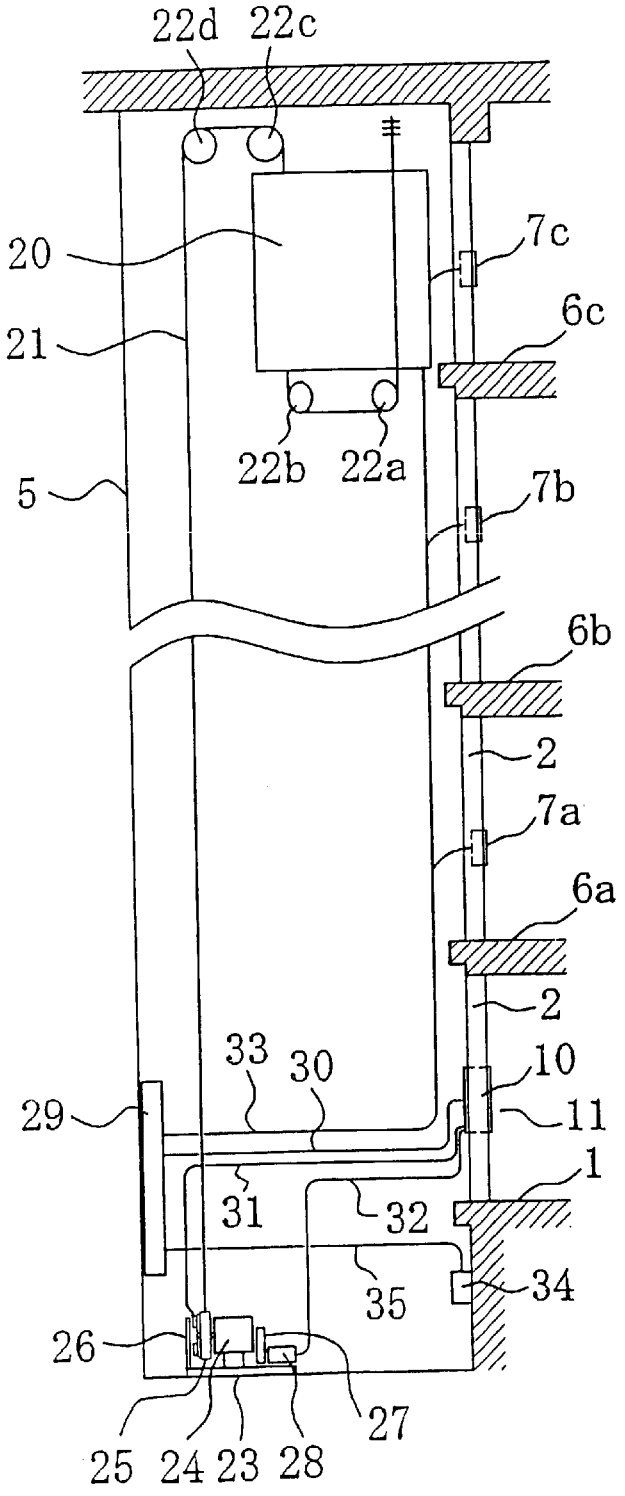
FIG. 3 is a cross-sectional view of a hoistway, showing components of the maintenance driving apparatus disposed in the elevator.
Figure 4:
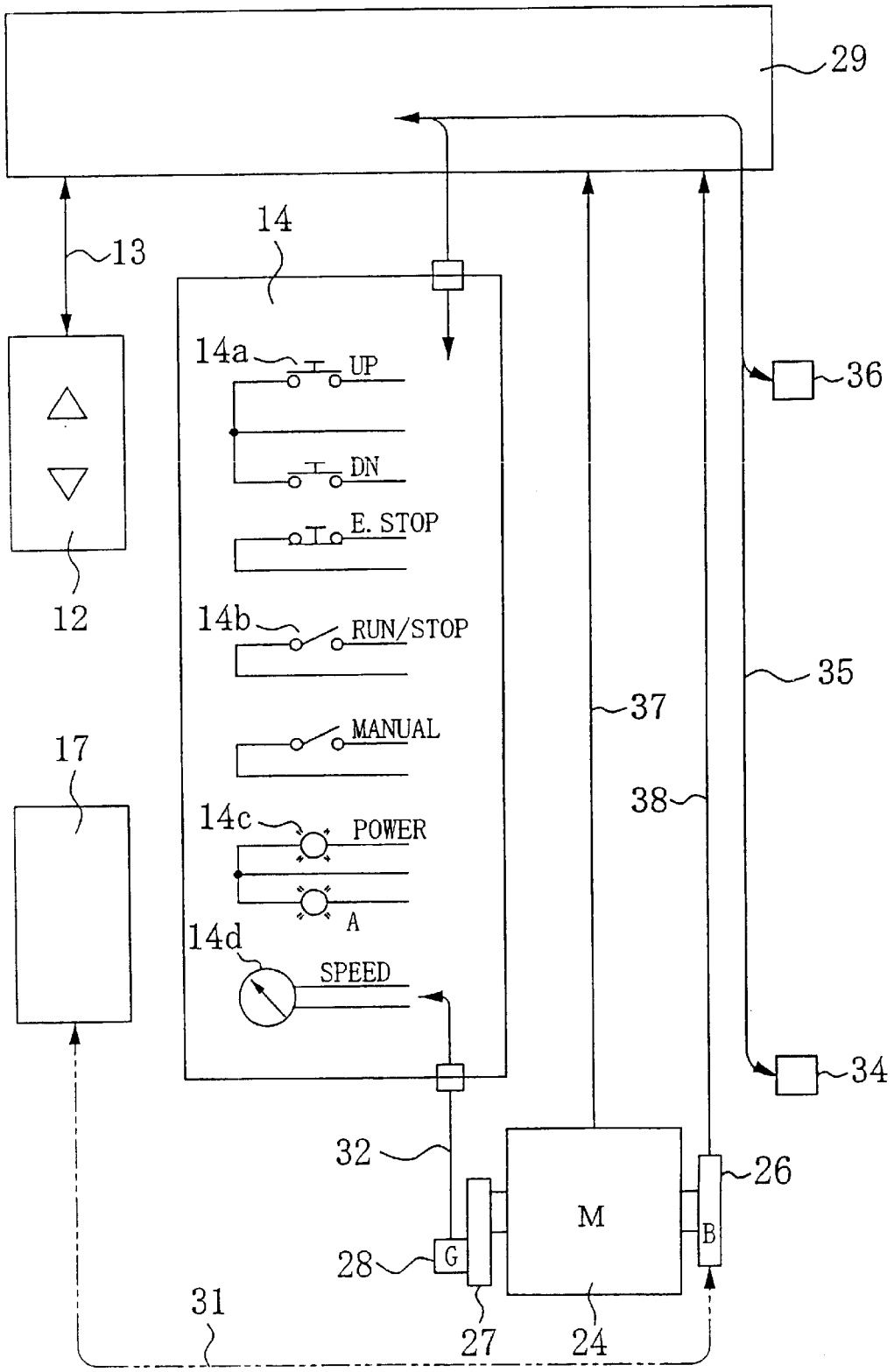
FIG. 4 is a component connection diagram showing connections between components of the maintenance driving apparatus.

FIG. 2 is a perspective view of the maintenance operation panel 10 of the elevator maintenance driving apparatus in Embodiment 1 of the present invention, showing a state where the face plate 11 of the maintenance operation panel 10 is opened. FIG. 3 is a cross-sectional view of a hoistway, showing operating components which are disposed in the elevator, and which relate to the maintenance driving apparatus. FIG. 4 is a component connection diagram showing connections between components of the maintenance driving apparatus. The same reference characters in these figures designate the same components.

In FIG. 2, reference numeral 12 denotes a hall button unit attached to the face plate 11, the back surface of the hall button unit 12 being shown. Reference numeral 13 denotes a call signal line provided for transmission of a call signal from the hall button unit 12 to a control panel described below. Reference numeral 14 denotes a driving operation panel detachably mounted in the maintenance operation panel 10. The driving operation panel 14 has interface devices required in maintenance operations, such as push-button switches 14*a,* seesaw switches 14*b,* indication lamps 14*c* and a meter 14*d.* Reference numeral 15 denotes a signal transmission line provided for exchange of signals between the driving operation panel 14 and the control panel or components of the maintenance driving apparatus described below. The signal transmission line 15 is connected through a connector 16. Reference numeral 17 denotes a brake release device, and 18 denotes an operating arm of the brake release device 17. Reference numeral 19 denotes an inspection hole capable of being opened and closed, which is provided in the driving operation panel 14.

In FIG. 3, reference numeral 5 denotes the hoistway in which the elevator is raised and lowered, and 6*a,* 6*b,* and 6*c* denote halls on floors where no driving operation panel 14 is provided. Reference numeral 7 denotes hall buttons 7*a,* 7*b* and 7*c* each operated for entry of a call from the corresponding hall. Reference numeral 20 denotes a car provided in the hoistway 5, which passengers get on. Reference numeral 21 denotes a main rope used to suspend the car 20 and to move the car 20 up and down. Reference numeral 22 denotes sheaves 22*a,* 22*b,* 22*c* and 22*d* around which the main rope 21 is wound. The sheaves 22*a* and 22*b* support the car, and the sheaves 22*c* and 22*d* are attached to the hoistway. Reference numeral 23 denotes a hoisting machine that drives the main rope 21. The hoisting machine 23 has a motor 24, a driving sheave 25 around which the main rope 21 is wound, and which applies a driving force from the motor 24 to the main rope 21, a brake unit 26 for stopping the rotation of the hoisting machine 23, a reduction mechanism 27 for transmitting a torque from the motor 24 while reducing the speed, and a generator 28 which is rotated at a reduced speed by a torque from the motor, and which generates a voltage corresponding to the rotation. Reference numeral 29 denotes the control panel which performs operation management of the elevator and controls the operation of driving the elevator.

Reference numeral 30 denotes a first signal transmission line composed of portions of the call signal transmission line 13 and the signal transmission line 15 connecting the driving operation panel 14 and the control panel 29. Reference numeral 31 denotes an operating wire used to transmit an operation of the brake release device 17 to the brake unit 26, 32 denotes a speed signal line which is a portion of the signal transmission line 15 for transmitting the voltage generated by the generator 28 to the meter 14*d,* and 33 denotes a hall call signal transmission line provided for signal exchange between the control panel 29 and the hall button 7 provided on each floor. Reference numeral 34 denotes a hoistway connection box provided in the hoistway, and 35 denotes a second signal transmission line that connects the hoistway connection box 34 and the control panel 29.

In FIG. 4, reference numeral 36 denotes a car connection box provided on the car and also connected to the control panel 29 by the second signal transmission line 35, as is the hoistway connection box 34. Reference numeral 37 denotes a main circuit which connects the control panel 29 and the motor 24, and 38 denotes a brake circuit which connects the control panel 29 and the brake unit 26. The first signal transmission line 30 and the second signal transmission line 35 are connected in parallel in the control panel 29.

In the above-described elevator, since the maintenance operation panel 10 provided in the hall 1 has necessary functions for maintenance operations, an maintenance operator can perform maintenance operations without entering the hoistway. That is, the maintenance operator goes to the hall 1 where the maintenance operation panel 10 is provided, opens the face plate 11 of the maintenance operation panel 10 having the hall button unit 12 ordinarily operated by passengers, and takes out the driving operation panel 14 for performing driving operations or makes the driving operation panel 14 ready for use. Then the operator can operate a "RUN/STOP" switch in the seesaw switches 14*b* shown in FIG. 4 or an "E. STOP" switch in the push-button switches 14*a* to stop the operation of the elevator. Also, the operator operates a "MANUAL" switch in the seesaw switches 14*b* to change the operation mode to a maintenance operation mode. Thereafter, the operator can effect upward driving or downward driving of the car 20 at a low speed required in maintenance driving while pressing an "UP" or "DN" button in the push-button switches 14*a*. When the power for the elevator is on, a lamp "POWER" in the indication lamps 14*c* is lighted. When the brake unit 26 of the hoisting machine 23 is operated to continue stopping the rotation, a lamp "A" is lighted. These operations are the same as those performed through the conventional control panel, and will not be described in detail in this description. Devices which may be provided in the driving operation panel are not limited to those described above. Thus, it is possible to perform maintenance driving operations without entering the hoistway in which the control panel is provided. When maintenance operations are not performed, the maintenance operation panel 10 is concealed behind the face plate 11. Ordinary, only the face plate 11 with the hall button unit 12 appears in the wall 2 of the hall 1, thus achieving a favorable appearance design.

Elevator maintenance operations are not limited to those executable through the driving operation panel, and include operations for rescuing passengers in the car when the car is disabled from operating. Conventionally, since the hoisting machine is provided in the machine room formed separately from the hoistway, a maintenance operator directly releases the brake unit of the hoisting machine in the machine room to enable the car to move upward/downward by the weight of the car to the nearest hall and rescues passengers from the car. In contrast, in the case where the hoisting machine is provided in the hoistway, it is considerably dangerous for the operator to enter the hoistway to release the brake of the hoisting machine. Depending on the place where the hoisting machine is installed, for example, in a case where the hoisting machine is placed in a top section of the hoistway, it is difficult even to access the brake unit when the car does not move. Accordingly, the brake release device 17 is connected to the maintenance operation panel 10 and is connected to the brake unit 26 by the operating wire 31, and the operating arm 18 of the brake release device 17 is pulled to transmit the pulling force to the brake unit 26 through the operating wire 31, thereby releasing the brake. Therefore, the maintenance operator can release the brake unit from the hall without entering the hoistway to move the car upward/downward, thus enabling rescue of passengers. At this time, the hoisting machine 23 is rotated and the rotation is transmitted to the generator 28 through the predetermined suitable reduction mechanism 27. Thus, the generator 28 generates a voltage according to the number of its revolutions, that is, according to the speed of the car. If the generator 28 is a DC generator having a permanent magnet as a field magnet, it does not require an external power supply and is capable of easily changing the polarity of the generated voltage determined by the direction of rotation. Then, the voltage generated by the generator 28 is transmitted to the meter 14*d* in the maintenance operation panel 10 through the speed signal line 32, and the generated voltage value, i.e., the voltage corresponding to the moving speed of the car is indicated by the meter 14*d*. It is possible to know the speed of the car moving upward or downward or the downward or upward direction of movement of the car from the polarity of the voltage. Consequently, it is possible to controllably perform the break release operation. In this embodiment, the generator and the meter are directly connected, so that the speed of the car can be indicated even when, for example, supply of power to the control panel is stopped. This function is effective in a rescue operation. Moreover, there is no need for preparing a backup power supply.

The maintenance operation panel 10 of the present invention is provided with the inspection hole 19. For example, when the operator releases the brake to enable rescue as described above, the operator can open the inspection hole 19 and check the inside of the hoistway with the eye to ascertain whether the car has arrived at the hall where rescue is possible. Also, on a component of the elevator placed in such a position so as to be visible through the inspection hole 19, for example, a rope moved together with the car, a mark is put in advance at such a position as to be visible through the inspection hole when the car is stopped at a position at which rescue can be performed. The operator stops the car when the mark is visible at a predetermined position through the inspection hole. Thus, this car position confirmation device makes it possible to stop the car at a suitable position.

That is, the operator moves the car upward or downward by operating the brake release device 19, adjusts the car speed by monitoring the meter 14*d*, observes the inside of the hoistway through the inspection hole 19, and stops the car by terminating the operation of releasing the brake when confirming with the eye that the car has reached the rescue position.

The driving operation panel 14 of the maintenance operation panel 10 of the present invention can be disconnected from the signal transmission line 15 at the connector 16. The operator may again connect the driving operation panel 14 to the hoistway connection box 34 provided at the other end of the second signal transmission line 35 connected parallel to the signal transmission line 15 in the control panel 29, or to the car connection box 36 to perform maintenance driving operations in the hoistway or the car.

As described above, the maintenance driving apparatus having the maintenance operation panel 10 enables maintenance driving operations without entering the hoistway. Also, the maintenance operation panel 10 is covered with the hall button unit ordinarily used, so that it does not impair the hall design.

Embodiment 2

Figure 5:
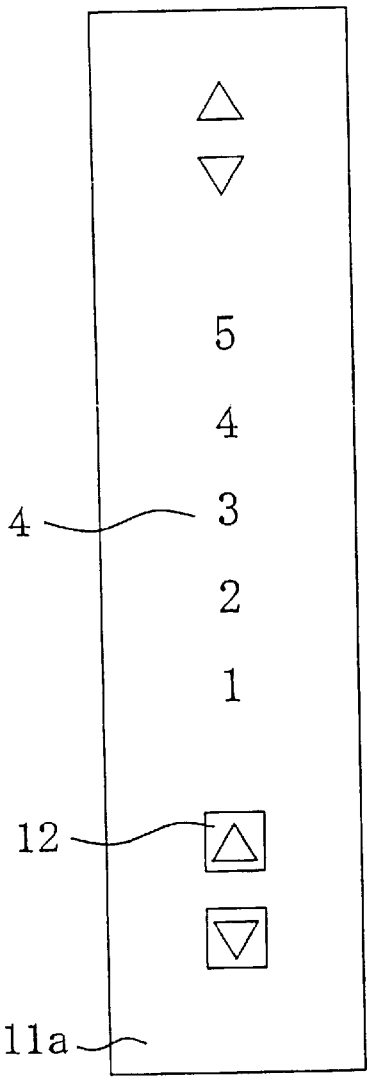
FIG. 5 is a front view of a maintenance driving apparatus in Embodiment 2, which is another embodiment of the present invention.
Figure 6:
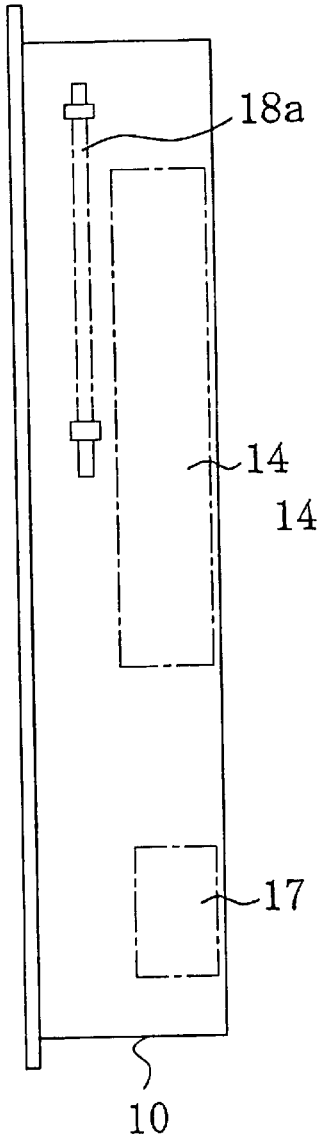
FIG. 6 is a side view of the maintenance driving apparatus shown in FIG. 5.
Figure 7:
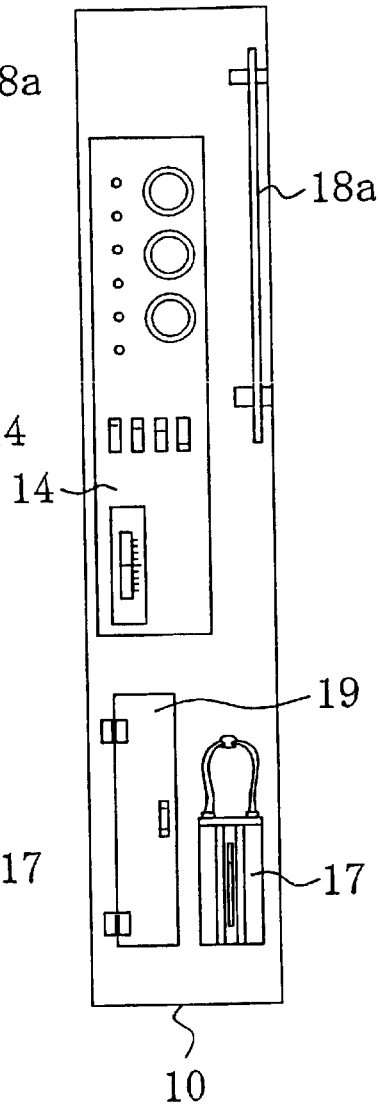
FIG. 7 is a front view of the maintenance driving apparatus shown in FIG. 5, showing a state where a face plate is removed.
Figure 8:
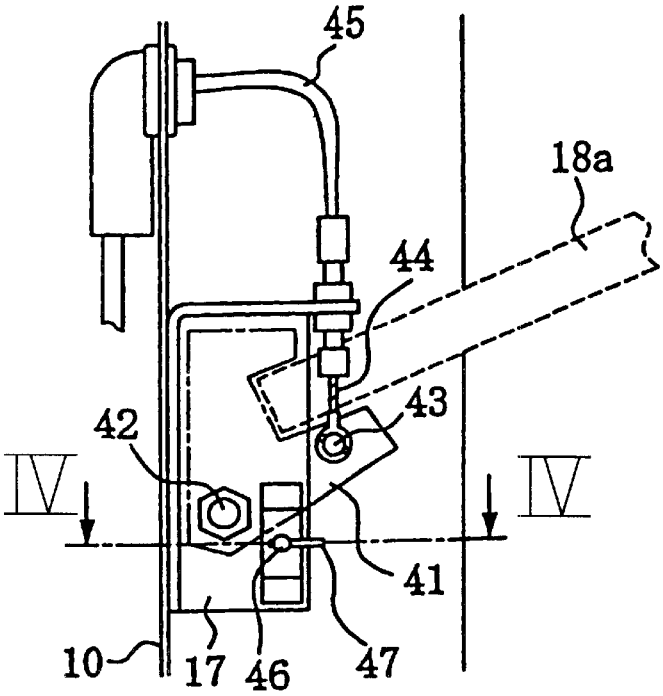
FIG. 8 is a diagram showing details of a portion of a brake release device of the maintenance driving apparatus shown in FIG. 5.
Figure 9:
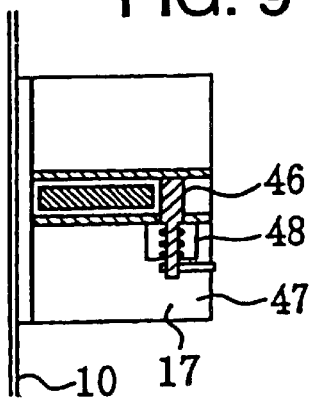
FIG. 9 is a cross-sectional view of a lock pin portion of the brake release device taken along the line IX—IX of FIG. 8.
Figure 10:
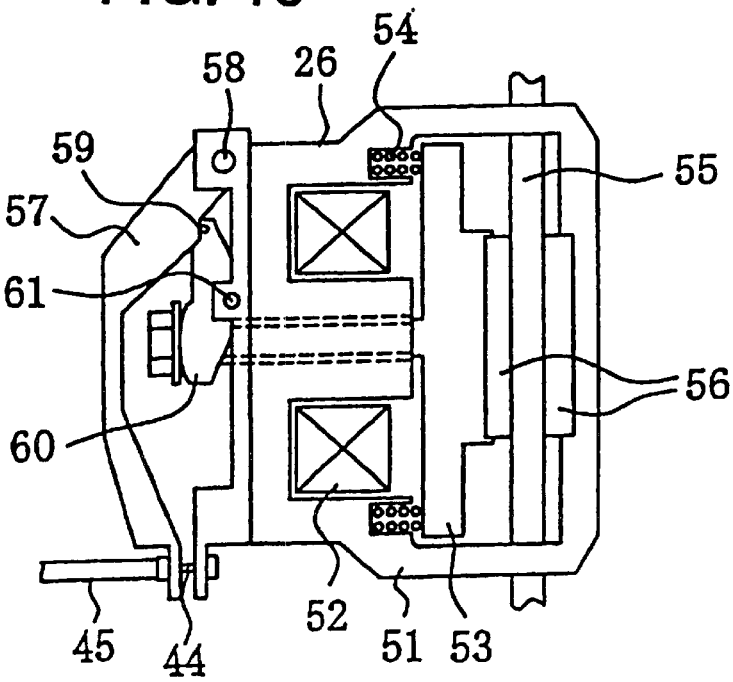
FIG. 10 is a diagram for explaining the operation of a brake unit attached to a hoisting machine.

This embodiment of the present invention will be described with respect to a maintenance operation panel differing in structure from that of Embodiment 1, and details of a bake release device. FIG. 5 is a front view of a portion of a maintenance driving apparatus, and FIG. 6 is a side view of the portion shown in FIG. 5. FIG. 7 is a front view of the portion of the maintenance driving apparatus shown in FIG. 5 in a state where a face plate has been removed. FIG. 8 is a diagram showing details of a portion of the brake release device of the maintenance driving apparatus shown in FIG. 5. FIG. 9 is a cross-sectional view of a lock pin portion of the brake release device taken along the line A—A of FIG. 8. FIG. 10 is a diagram for explaining the operation of the brake device attached to the hoisting machine.

In these figures, the same components or portions as those in the above-described embodiment are indicated by the same reference numerals. Referring to FIG. 5, reference symbol 11*a* denotes a face plate of the maintenance operation panel 10, which has the hall button unit 12 and the indicator 4 shown in Embodiment 1. In FIG. 6, outlines of portions of components incorporated in the maintenance operation panel 10 are indicated by dot-dash lines. A component 18*a* is an operating arm detached from the brake release device 17. Referring to FIG. 7, the operating arm 18*a* detached is held on an inner surface of the maintenance operation panel 10.

FIG. 8 shows details of the brake release device 17. Reference numeral 41 denotes an operating arm receiver which receives a torque from the operating arm 18*a*, 42 denotes an operating shaft on which the operating arm receiver 41 is pivotally moved, 43 denotes an action pin positioned at a distance from the operating shaft 42 of the operating arm receiver 41, 44 denotes a wire connected to the action pin 43, and 45 denotes a tube through which the wire 44 is passed. A force is transmitted by a relative motion of the wire and the tube when the wire is moved in an insertion or extraction direction. The wire 44 and the tube 45 form the operating wire 31. Reference numeral 46 denotes a stopper pin provided to stop the rotation of the operating arm receiver 41, and 47 denotes an operating pin 47 used to slide the stopper pin 46. Referring to FIG. 9, which is a cross-sectional view taken along the line IX—IX of FIG. 8, reference numeral 48 denotes a stopper spring which urges the stopper pin 46 to a position at which the stopper pin 46 can stop the movement of the operating arm receiver 41.

FIG. 10 is a diagram for explaining the operation of releasing the brake unit 26 attached to the hoisting machine 23. Reference numeral 51 denotes a base of the brake unit 26, 52 denotes a magnetic coil attached to the base 51, and 53 denotes a movable element which forms a magnetic circuit in association with the base 51 when the magnetic coil 52 is energized, and which is thereby attracted to the base 51. Reference numeral 54 denotes a detachment spring for detaching the movable element 53 from the base 51 when the magnetic coil 52 is de-energized, 55 denotes a brake plate attached to a rotating shaft (not shown) of the hoisting machine 23, and 56 denotes brake shoes for producing a braking force by pinching the brake plate 55. That is, when the magnetic coil 52 is not energized, the detachment spring 54 urges the movable element 53 to press the brake shoes 56 against the brake plate 55 to produce the braking force. When the magnetic coil 52 is energized, the movable element 53 is attracted to the base 51, so that the brake shoes 56 are disengaged from the brake plate 55 to release the brake.

Further, reference numeral 57 denotes a first release arm which receives the motion of the tube 45 relative to the wire 44 in the insertion or extraction direction, 58 denotes a first pin for pivotally supporting the first release arm 57 on the base 51, 59 denotes a linkage pin which receives the movement of the first release arm, 60 denotes a second release arm which receives the movement through the linkage pin to urge the movable element 53, and 61 denotes a second pin for pivotally supporting the second release arm 60 on the base 51. When the first release arm 57 is moved toward the base 51 by the relative motion of the wire 44 and the tube 45, it moves pivotally on the first pin 58 to press the linkage pin 59 in the direction of the base 51. The second release arm 60 having the linkage pin attached thereto moves pivotally on the second pin 61 to move the movable element 53 in the same direction as the direction in which the movable element 53 is moved when the excitation coil 52 is energized. The brake shoes 56 are thereby disengaged from the brake plate 55, thus releasing the brake.

In this elevator maintenance driving apparatus, the face plate is formed by the hall button unit, the indicator, and the like, which can usually be seen by passengers in the hall, and the maintenance devices in the maintenance operation panel 10 are hidden behind the face plate. When maintenance operations are performed, the face plate is opened as shown in FIG. 7 to enable the maintenance devices in the maintenance operation panel 10 to be operated. In this embodiment, the operating arm 18*a* of the brake release device 17 is separable and is kept in the same maintenance operation panel 10.

To release the brake, the operating arm 18*a* is brought into engagement with the operating arm receiver 41, as shown in FIG. 8, and is moved pivotally on the operating shaft 42 to draw the wire 44 relative to the tube 45. Before this operation, the operating pin 47 is slid against the urging force of the stopper spring 48 to move the stopper pin 46, thereby enabling the pivotal motion of the operating arm receiver 41. These components form a lock mechanism for checking release of the brake. The relative motion of the tube 45 and the wire 44 is transmitted to the brake unit 26 to move the first release arm 57 toward the base 51, thereby releasing the brake.

As described above, the maintenance driving apparatus having the maintenance operation panel 10 of the present invention enables maintenance driving operations without entering the hoistway. Also, the maintenance operation panel 10 is covered by the hall button unit and the indicator ordinarily operated, and does not impair the hall design. Since the brake release device is provided with the stopper pin, the brake cannot be released by only attaching and operating the operating arm. Thus, the brake device is prevented from being inadvertently operated. The operating arm used for releasing the brake can be separated from the brake release device and can be accommodated in the maintenance operation panel. Thus, there is no need for an unnecessarily large increase in the size of the maintenance operation panel for the operating arm. The structure and configuration of the brake release device 17 or the brake unit 26, and the transmission mechanism constituted of the wire 44 and the tube 45 are not limited to those in this embodiment, and any other devices or members may suffice if they enable release of the brake by remote operation.

Embodiment 3

Figure 11:
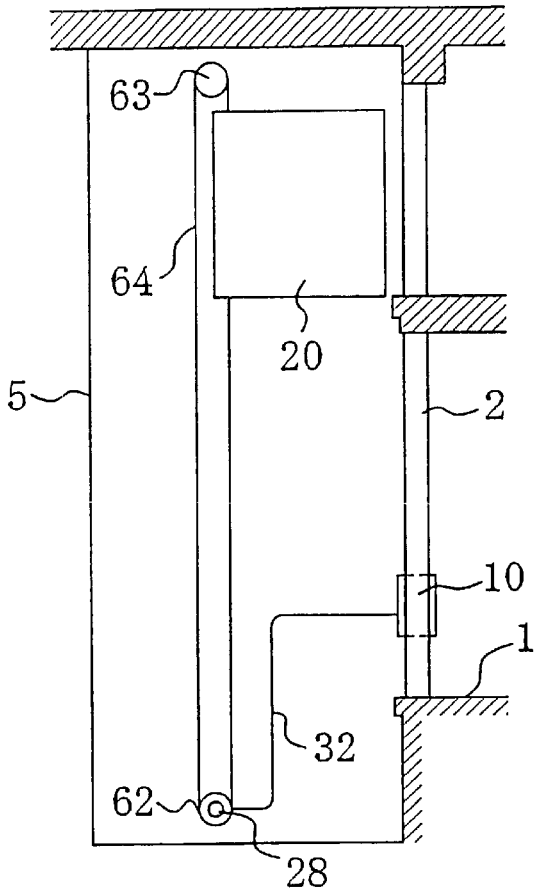
FIG. 11 is a diagram showing a generator attached to a speed governor in Embodiment 3, which is still another embodiment of the present invention.

This embodiment differs from Embodiment 1 in the way of attaching the generator. FIG. 11 is a diagram showing the generator 28 attached to a speed governor. Reference numeral 62 denotes the speed governor provided at one end of the hoistway 5 to detect an excessive speed of the car 20, 63 denotes a stretch sheave provided at the other end of the hoistway, and 64 denotes a governor rope having its two ends connected to the car and stretched between the speed governor and the stretch sheave in the hoistway 5. When the car 20 moves upward or downward, the speed governor 62 is rotated by the governor rope 64, and the generator 28 attached to the speed governor generates a voltage according to the rotational speed of the governor. This voltage is transmitted to the maintenance operation panel 10 via the speed signal line 32 to be indicated by the meter 14*d* incorporated in the maintenance operation panel.

The speed of the car at the time of release of the brake can be known through the maintenance operation panel even when the supply of power to the elevator is stopped. The generator 28 may be attached to the stretch sheave 63 instead of being attached to the speed governor 62. The same effect can also be obtained in such a case.

Embodiment 4

Figure 12:
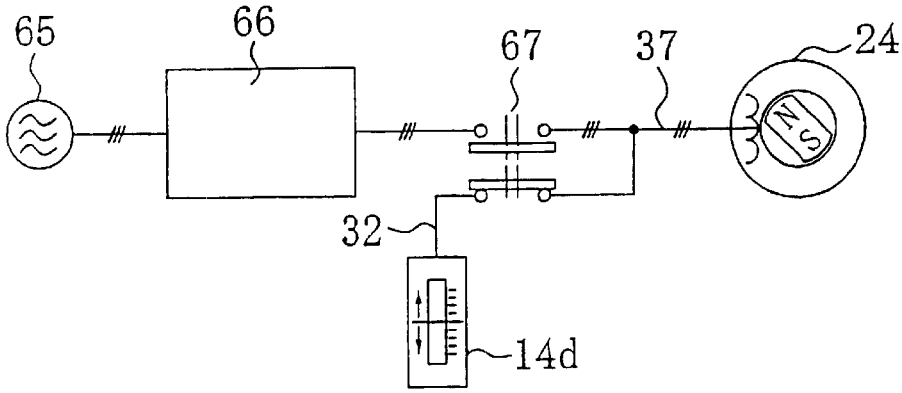
FIG. 12 is a circuit diagram showing use of the hoisting machine motor as a generator in Embodiment 4, which is a further embodiment of the present invention.

This embodiment differs from Embodiment 1 in that the motor of the hoisting machine is utilized as a generator. FIG. 12 is a circuit diagram showing use of the hoisting machine motor as a generator. Reference numeral 65 denotes a power supply for the elevator, 66 denotes a drive control unit, which is supplied With power from the power supply 65 and controllably drives the motor 24, and 67 denotes a contact device having normally open contacts and provided in the main circuit between the drive control unit 66 and the motor 24. The contact device 67 is provided with the speed signal line 32 which branches off from the motor 24 side of the contact device 67, and extends to the meter 14*d* via normally closed contacts of the contact device 67.

The contact device 67 is normally energized magnetically to connect the motor 24 to the drive control circuit 66. In this state, the motor 24 is driven to move the elevator upward or downward. However, when an abnormality occurs, or when the power supply is cut to perform maintenance operations, the contact device 67 is de-energized to connect the motor 24 to the meter 14*d* of the maintenance operation panel 10 by the speed signal line 32. If the motor 24 is, for example, of a type using a permanent magnet as a field magnet, a voltage is generated across the armature of the motor according to the rotation of the motor. Then the speed at which the car moves by its weight after release of the brake can be indicated by the voltage generated by the motor, thereby enabling the operator to know the speed at which the car moves upward or downward with the maintenance operation panel.

Embodiment 5

Figure 13:
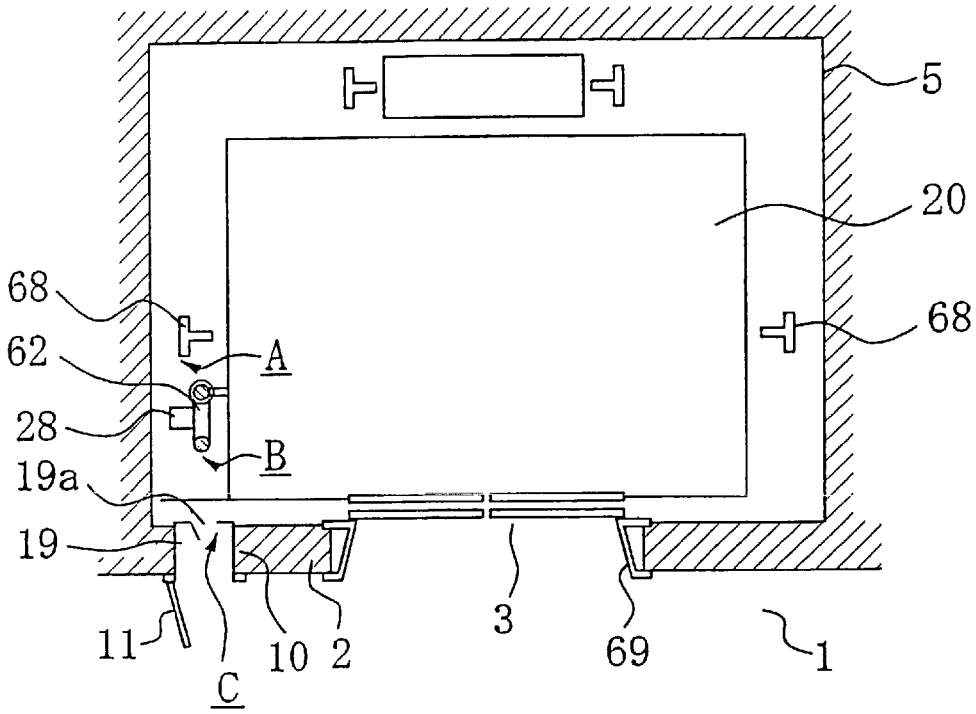
FIG. 13 is a cross-sectional view of a hoistway in Embodiment 5, which is still a further embodiment of the present invention.
Figure 14:
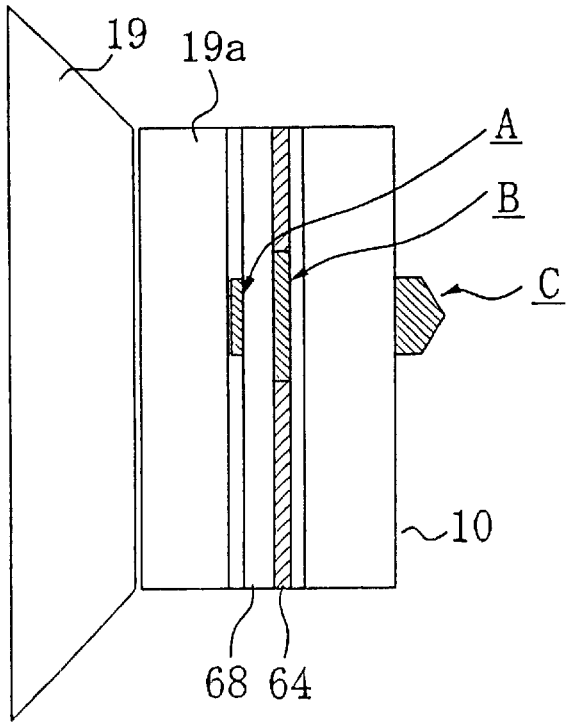
FIG. 14 is a diagram showing a state where the inside of the hoistway is seen through an inspection hole of the maintenance operation panel.

This embodiment will be described with respect to an example of the car position confirmation device for recognizing the position of the car in the hoistway through the maintenance operation panel. FIG. 13 is a cross-sectional view of the hoistway, and FIG. 14 is a diagram showing a state where a inspection hole 19 of the maintenance operation panel 10 is opened and the inside of the hoistway is seen through a window 19*a* of the inspection hole 19. In these figures, the same components or portions as those in the above-described embodiments are indicated by the same reference numerals.

Referring to FIGS. 13 and 14, reference numeral 68 denotes rails provided in the hoistway 5 to guide the car 20 moving upward or downward. Reference numeral 69 denotes jambs provided on the opposite sides of the door 3 of the hall. The window 19*a* is formed in the maintenance operation panel 10. When the inspection hole 19 is opened, the inside of the hoistway can be seen through the window 19*a*. A portion A shown in the figure is a reference mark which is put on a side surface of the rail 68, and which can be recognized with the eye through the inspection hole window 19*a*. A portion C is a check mark put on a portion of the maintenance operation panel by the side of the window 19*a* in correspondence with the reference mark A. A portion B is a car position mark put on the governor rope 64 for the speed governor 62.

The car position mark B is put on the governor rope 64 at a position on a line connecting the reference mark A and the check mark C, for example, when the car 20 is at the position corresponding to the hall 1 or 6, at which passengers can get on or off the car 20. When the car 20 is stopped by a malfunction or the like at a position at which passengers cannot get on or off the car 20, the operator opens the maintenance operation panel 10 and opens the inspection hole 19 to be able to observe the inside of the hoistway. In this state, the operator operates, for example, the brake release device 17 while monitoring the speed of the car 20 through the meter 14*d*, and stops the brake releasing operation when the car position mark B on the governor rope 64 reaches the point between the reference mark A and the check mark C, thereby stopping the car to enable passengers in the car to escape form the car and enter the hall.

The car position mark B is not limited to the positions corresponding to the floors 1 and 6 at which passengers can get on or off the car. The car position mark B may designate a certain position at which the car should be stopped. The color and/or width of the mark may be changed, that is, variations of the mark may be formed based on a kind of code so as to be discriminable from each other. Even if one of the reference mark A and the check mark C is removed, the above-described function can be attained. Also, the position at which the reference mark A or the check mark C is put is not limited to that described above. Also, the car position mark B is not necessarily formed on the governor rope 64. It may be put on any portion movable with the movement of the car. For example, it may be put on the main rope 21 shown in FIG. 3.

As described above, in the maintenance operation panel 10 of the present invention, which has the window 19*a* of the inspection hole 19, the mark B is put on a member which can be recognized with the eye through the window, and which moves with the movement of the car. It is possible to know the position of the car by checking this mark. Therefore, there is no need to enter the hoistway or to move the car while opening the hall door. Also, the elements necessary for the operations are concentrated on the maintenance operation panel, so that only one maintenance person can perform the operations.

INDUSTRIAL APPLICABILITY

The maintenance operation panel has a driving operation panel formed by combining switches, and the like, which are to be operated for maintenance operations, and which are separately provided as counterparts of those in the control panel, a brake release device capable of releasing the brake of the hoisting machine by remote operation without the intervention of the control panel, a meter for indicating a voltage converted from the upward or downward movement of the elevator car by a speed generator, and/or car position confirmation means including an open window in a portion of the maintenance operation panel through which the inside of the hoistway can be observed with the eye, and through which ropes and other members moving with the movement of the car can be seen, the confirmation means including a mark on some of the ropes and other members from which the position of the car can be ascertained. The maintenance operation panel is provided on a hall for the elevator. Therefore, in the elevator having no machine room and having the control panel or the hoisting machine provided in the hoistway, when a need arises to operate the car for a maintenance operation, an operator can operate the driving operation panel in the hall to perform maintenance operation of the car without entering the hoistway. Even when the car is stopped in the hoistway for some reason, the brake of the hoisting machine can be released by operating the brake release device in the maintenance operation panel. In this event, the speed at which the car runs may be converted into a voltage by the generator attached to the hoisting machine or a governor to be indicated by the meter provided in the maintenance operation panel, thereby enabling the operator to know the car speed and to suitably control the operation of releasing the brake. Also, a window, through which ropes and other members moving in the hoistway with the movement of the car can be seen, may be formed in the maintenance operation panel. For example, a mark may be put on a portion of some of the ropes and other members which can be seen through the window when the car is landed at a predetermined floor. Thus, it is possible to ascertain that the car is at the position of being landed at the predetermined floor when the mark is seen through the window at the predetermined position. If the operation of releasing the brake is stopped when the car reaches the predetermined position, the car can be stopped at the predetermined position. A hall button unit may be mounted in the face panel that faces the hall of the maintenance operation panel. Thus, ordinarily, only the face plate with the hall button unit can be seen from the hall, and therefore a hall design can be impaired.

The operating arm of the brake release device may be made detachable to limit the size of the maintenance operation panel. Also, a space for accommodation of the operating arm may be provided in the maintenance operation panel to enable the operating arm to be quickly taken out to be used for the operation of releasing the brake. The brake release device is arranged so that the brake release operation cannot be performed without unlocking a lock mechanism, thereby preventing the brake from being inadvertently released when the operating arm is attached.

If the speed generator attached to the hoisting machine or speed governor is a DC generator using a permanent magnet, the polarity of the voltage generated is changed according to the direction of rotation. Then, if the meter that indicates the polarity is capable of swinging in opposite directions, it is possible to know the direction of movement of the car. The generator may be connected through a suitable reduction mechanism to generate a voltage for setting a suitable swinging angle of the meter. In particular, if the motor of the hoisting machine is of a type having a permanent magnet as motor may be extracted and supplied to the meter to indicate the car speed.

As described above, the driving operation panel in the maintenance operation panel is operated to electrically remote control the control panel, and the like, and the brake release device in the maintenance operation panel is operated to directly release the brake of the hoisting machine when electrical operations are disabled by stoppage of power supply. The maintenance operator can know the speed of the car started by release of the brake by means of the generator independently provided and the meter in the maintenance operation panel. Further, when the car moves to a predetermined position, the operator can ascertain the present position of the car by recognizing a mark on a rope or the like connected to the car through the window provided in the maintenance operation panel, and can stop the operation of releasing the brake at the predetermined position. Therefore, even when passengers are trapped in the car, it is possible to easily rescue the passengers.

What is claimed is:

1. A maintenance driving apparatus for an elevator, comprising a maintenance operation panel located separately from a control panel of the elevator, and having a driving operation panel for commanding maintenance driving with respect to upward and downward movements of a car, and at least one of a brake release device connected to a brake of a hoisting machine for releasing the brake, a meter connected to a generator for converting the movement of the car into a voltage, the meter indicating the voltage generated by the generator, and car position confirmation means enabling indirect visual ascertainment of position of the car moving upward or downward in a hoistway, said maintenance operation panel being provided proximate an elevator hall serviced by the elevator.

2. The maintenance driving apparatus for an elevator as defined in claim 1, wherein said maintenance operation panel has a face plate facing the elevator hall and including hall call buttons.

3. The maintenance driving apparatus for an elevator as defined in claim 1, including said brake release device wherein said brake release device has a detachable operating arm.

4. The maintenance driving apparatus for an elevator as defined in claim 3, including an operating arm accommodation mechanism in said maintenance operation panel.

5. The maintenance driving apparatus for an elevator as defined in claim 3, wherein said brake release device has a lock mechanism which, when locked, stops releasing of the brake of the hoisting machine, and, when unlocked, releases the brake, by operation of the operating arm.

6. The maintenance driving apparatus for an elevator as defined in claim 1, including said meter, said meter swinging in opposite directions corresponding to polarities of the voltage, and upward and downward movement of the car.

7. The maintenance driving apparatus for an elevator as defined in claim 1, including said meter and said generator for detecting movement of the car, a field magnet of said generator being a permanent magnet.

8. The maintenance driving apparatus for an elevator as defined in claim 1, including said meter and said generator, wherein said generator is connected to the hoisting machine through a reduction mechanism having a reduction ratio set such that said generator generates a voltage converted into speed of the car indicated by said meter.

9. The maintenance driving apparatus for an elevator as defined in claim 1, including said generator for detecting movement of the car, said generator being attached to a speed governor.

10. The maintenance driving apparatus for an elevator as defined in claim 1, including said meter and further comprising a motor for driving the hoisting machine, a drive control unit for controllably driving said motor according to an elevator run command, and a first contact device in a main circuit between said motor and said drive control unit, said meter being connected to a line which branches from a point between said first contact device and said motor and extends to a second contact device, and, when said first contact device is open and when said second contact device is connected to the line, a voltage generated by said motor is indicated by said meter.

11. The maintenance driving apparatus for an elevator as defined in claim 1, including said car position confirmation means, said car position confirmation means includes a window in said maintenance operation panel opening to the hoistway, so that a portion of the elevator moving upward or downward in the hoistway may be visually recognized through said window.

12. The maintenance driving apparatus for an elevator as defined in claim 11, wherein said car position confirmation means includes a car position mark on one of a main rope and a speed governor rope moving together with the car, and, when said car position mark is at a position as seen through said window of said maintenance operation panel, the car is at a position corresponding to said car position mark.

13. The maintenance driving apparatus for an elevator as defined in claim 1, wherein said driving operation panel is connected to a first signal transmission line from the control panel by a connector and is detachably placed in said maintenance operation panel, and a connection box located in one of the hoistway and the car is connected to one end of a second signal transmission line branching from the first signal transmission line, said driving operation panel being detached from said maintenance operation panel by disconnecting the connector connected to the connection box for car maintenance.

* * * * *